US011585112B2

(12) United States Patent
Martinek

(10) Patent No.: US 11,585,112 B2
(45) Date of Patent: Feb. 21, 2023

(54) CORNER BRACKET FOR PORTABLE ENCLOSURE

(71) Applicant: Andrew Martinek, Middletown, VA (US)

(72) Inventor: Andrew Martinek, Middletown, VA (US)

(73) Assignee: Andrew Martinek, Middletown, VA (US)

( * ) Notice: Subject to any disclaimer, the term of this patent is extended or adjusted under 35 U.S.C. 154(b) by 68 days.

(21) Appl. No.: 17/357,081

(22) Filed: Jun. 24, 2021

(65) Prior Publication Data

US 2021/0404209 A1 Dec. 30, 2021

Related U.S. Application Data

(60) Provisional application No. 63/046,057, filed on Jun. 30, 2020.

(51) Int. Cl.
*E04H 15/04* (2006.01)
*E04H 15/44* (2006.01)

(52) U.S. Cl.
CPC ..... *E04H 15/04* (2013.01); *E04H 15/44* (2013.01)

(58) Field of Classification Search
CPC ..... E04H 15/04; E04H 15/44
See application file for complete search history.

(56) References Cited

U.S. PATENT DOCUMENTS 692,419 A * 2/1902 Broun ..... E04H 15/04 135/90
2,852,784 A 9/1958 Winkler
3,424,178 A * 1/1969 Yoshimi ..... E04B 1/34326 135/160
3,498,305 A * 3/1970 Hulin ..... E04H 15/04 135/117
3,545,461 A * 12/1970 Carlson ..... E04H 15/04 135/117
4,161,375 A * 7/1979 Murphy ..... F16B 7/0446 403/353
4,526,307 A * 7/1985 Parker ..... E04H 15/04 224/154
4,866,794 A 9/1989 Davies
5,930,971 A * 8/1999 Etheridge ..... E04H 15/34 52/63
5,970,536 A 10/1999 Suarez
9,347,238 B2 * 5/2016 Dominick ..... A61G 1/04
10,858,821 B2 * 12/2020 Ross ..... E04B 1/2604
(Continued)

*Primary Examiner* — Noah Chandler Hawk
(74) *Attorney, Agent, or Firm* — Benjamin C. Rothermel, Esq.

(57) ABSTRACT

A portable enclosure includes a plurality of corner brackets, a suspension ring, a plurality of cords respectively connecting each of the plurality of corner brackets and the suspension ring, a plurality of rigid rods respectively connecting each of the plurality of corner brackets, a plurality of rigid rod cords respectively connecting each of the plurality of rigid rods, a privacy curtain, a zipper in the privacy curtain, the zipper configured to permit ingress and egress from the privacy curtain, a plurality of grommeted elastic connectors connecting the privacy curtain and each of the plurality of corner brackets, and a webbing configured to restrain the bottom of the privacy curtain.

7 Claims, 9 Drawing Sheets

(56) References Cited

U.S. PATENT DOCUMENTS

| | | | | |
|---|---|---|---|---|
| 2006/0090786 | A1* | 5/2006 | Lapping | E04H 15/44 135/121 |
| 2015/0020857 | A1* | 1/2015 | Dominick | A61G 1/04 135/90 |

* cited by examiner

CORNER BRACKET FOR PORTABLE ENCLOSURE

CROSS-REFERENCE TO RELATED APPLICATION

This application claims priority from and the benefit of U.S. Provisional Patent Application No. 63/046,057, filed on Jun. 30, 2020, which is hereby incorporated by reference for all purposes as if fully set forth herein.

BACKGROUND

Field

Exemplary embodiments relate to portable enclosures for use in campgrounds, backcountry, or other out-of-doors applications, and more particularly to a portable shower, portable toilet, or visual privacy enclosure for use in areas where privacy is needed for personal hygiene related activities or other activities such as changing.

Discussion of the Background

U.S. Pat. No. 5,970,536 describes a freestanding shower system. While ideal for locations where transport weight and volume are not a concern and overhead support is not available, the design would be cumbersome for wooded backcountry locations and few to none of the components of the system would have secondary uses.

U.S. Pat. No. 4,866,794 describes a compact portable shower designed to be supported by a preexisting overhead structure. The design is a complete system with few to no reusable components when in a backcountry setting where weight and volume are both significant constraints.

U.S. Pat. No. 2,852,784 described a compact shower system designed for use in locations without existing infrastructure. However, in backcountry settings, the design is not practical for lightweight transport or individual transport.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a portable enclosure and a corner bracket.

Additional aspects will be set forth in the detailed description which follows, and, in part, will be apparent from the disclosure, or may be learned by practice of the inventive concept.

According to exemplary embodiments, a portable enclosure includes a plurality of corner brackets, a suspension ring, a plurality of cords respectively connecting each of the plurality of corner brackets and the suspension ring, a plurality of rigid rods respectively connecting each of the plurality of corner brackets, a plurality of rigid rod cords respectively connecting each of the plurality of rigid rods, a privacy curtain, a zipper in the privacy curtain, the zipper configured to permit ingress and egress from the privacy curtain, a plurality of grommeted elastic connectors connecting the privacy curtain and each of the plurality of corner brackets, and a webbing configured to restrain the bottom of the privacy curtain.

According to exemplary embodiments, a corner bracket includes a body area including a first end having a first hole therethrough and a second end having a second hole therethrough, and a first receptacle and a second receptacle connected to a second end of the body area, wherein the first receptacle and the second receptacle each has a tubular structure having an open end and an endcap and a slot extending from the open end, traversing the length of the tubular structure, and terminating in the endcap.

According to exemplary embodiments, a corner bracket includes a body including a first end having a first connection area and a second end having a second connection area, and a first receptacle and a second receptacle connected to the second end of the body, wherein the first receptacle and the second receptacle each has a tubular structure including an open end and an endcap, and a slot extending from the open end, traversing the length of the tubular structure, and terminating in the endcap.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
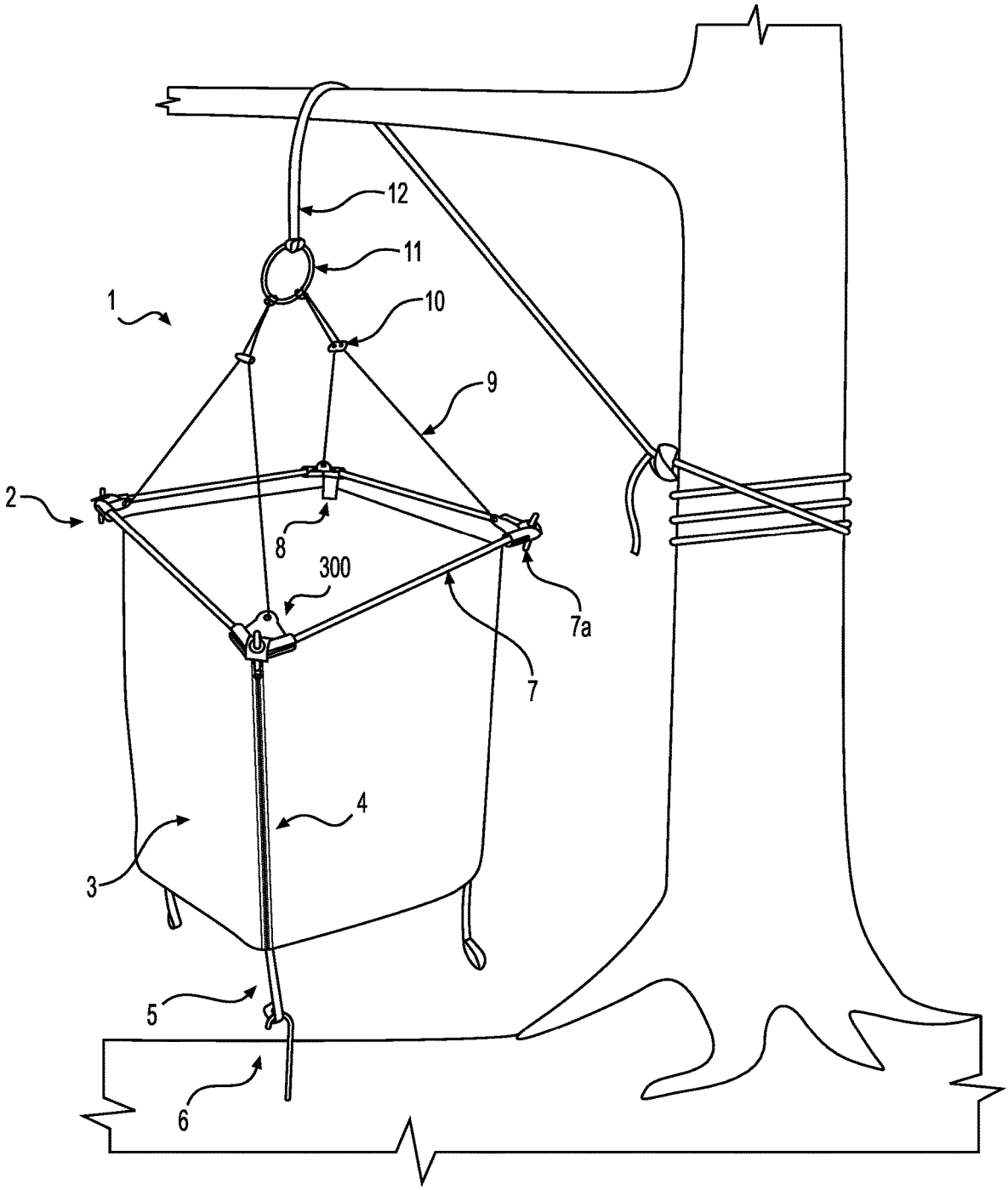
FIG. 1 shows a portable enclosure including a corner bracket according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In the accompanying figures, the size and relative sizes of layers, films, panels, regions, etc., may be exaggerated for clarity and descriptive purposes. Also, like reference numerals denote like elements.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 illustrates a portable enclosure 1 according to an exemplary embodiment. The portable enclosure 1 is shown in a typical configuration utilizing back up components for an outdoor excursion. Corner brackets 300 (described below with reference to FIGS. 4A and 4B) representing each of the corners of a four-sided polygon assembly 2 are held in place by a custom assembled tent pole assembly using rigid rods 7, such as tent pole assemblies, having rigid rod ends 7*a*, integral to the polygon assembly 2 at regular intervals. Grommeted elastic 8 is attached to a privacy curtain 3 and removably secured to the rigid rod ends 7*a* and the corner bracket 300 through a hole 305 in the corner bracket 300. Webbing 5 having a loop or grommet to removably attach ground stakes 6 is attached at each corner of the privacy curtain 3 closest to the ground. A zipper 4 in the privacy curtain 3 is used to provide an opening to the portable enclosure 1.

A cord 9 for suspending the portable enclosure 1 is removably attached to each of the corner brackets 300 and removably attached to a suspending ring 11. A guy line tensioner 10 is used to minimize tangling of the cord 9. The suspending ring 11 is affixed to the cord 9 suspending the polygon assembly 2 and the suspending ring 11 is suspended from a rope 12, which is connected to a pre-existing overhead structure such as a tree limb.

Figure 9:
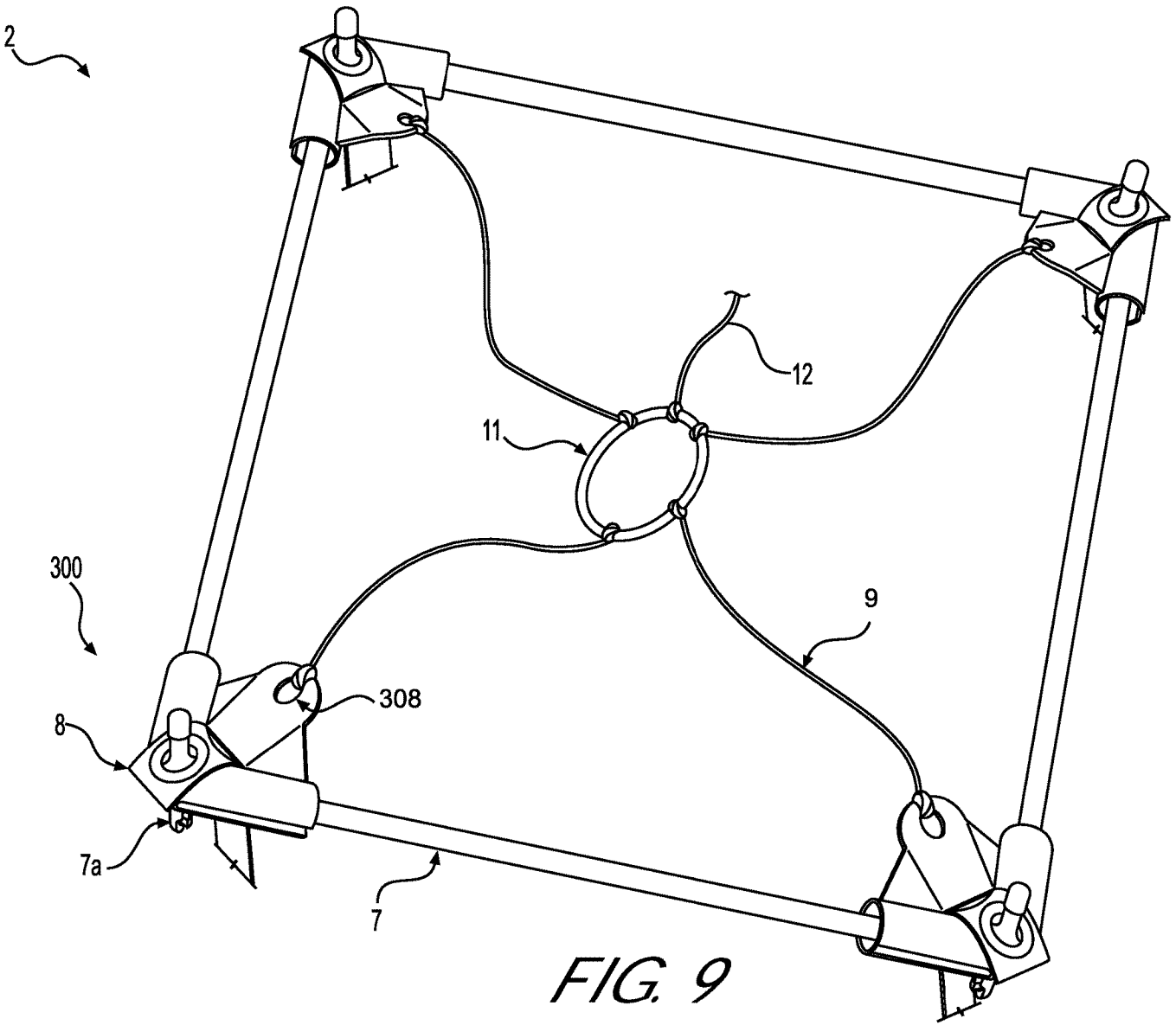
FIG. 9 shows a perspective view of the portable enclosure including a corner bracket according to the exemplary embodiment of FIG. 1.

FIG. 2, FIG. 3, and FIG. 4A and FIG. 4B illustrate corner brackets 100, 200 and 300, respectively, according to exemplary embodiments, and are used for assembling the polygon assembly 2 of FIG. 1 and FIG. 9. The corner brackets 100, 200 and 300 may be manufactured using injection molding or 3D printers.

Figure 2:
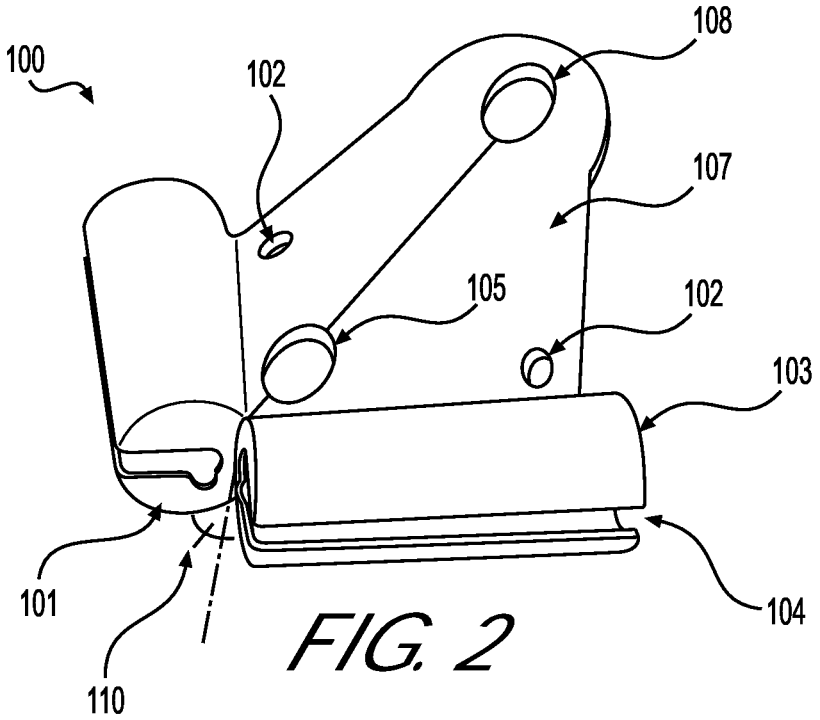
FIG. 2, FIG. 3, FIG. 4A, and FIG. 4B show perspective views of corner brackets according to various exemplary embodiments.

The corner bracket 100 illustrated in FIG. 2 includes a first hole 108 for removably attaching the cord 9 for suspending the portable enclosure 1, receptacles 103 for removably attaching rigid rods 7, endcaps 101 integral to the receptacles 103, a slot 104 traversing the length of the receptacle 103 and terminating in the endcap 101, for traversal of the rigid rod cord 601, a second hole 105 for removably attaching the privacy curtain 3, ancillary use eyelets 102, and a flat area 107 for mounting accessories such as a mirror or compass. The angle 110 between opposing receptacles 103 corresponds to the interior angle of a polygon representative of the number of sides desired for the portable enclosure 1. The angle 110 is equal to 180 degrees minus the interior angle of the polygon. For example, for a triangular portable enclosure 1 having interior angles of 60°, the angle 110 between opposing receptacles 103 would be 120°.

Figure 3:
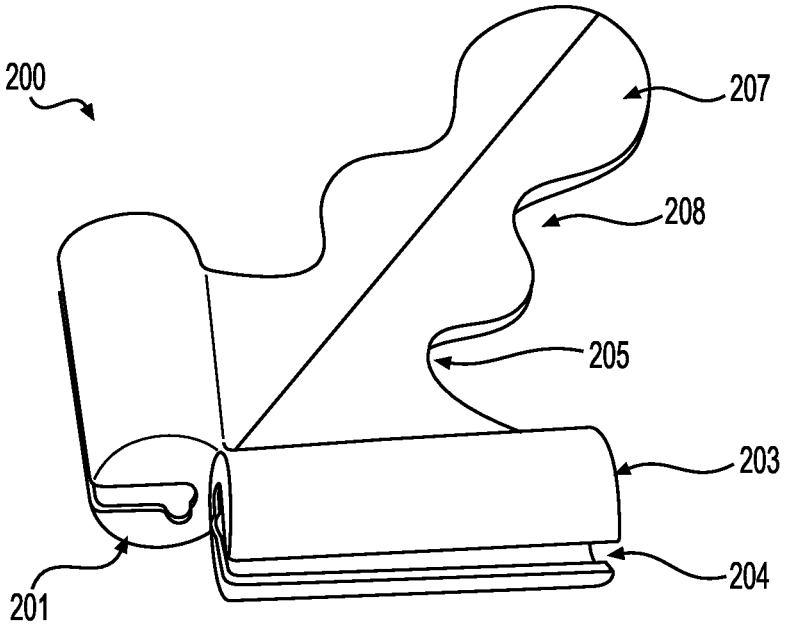
Figure 4A:
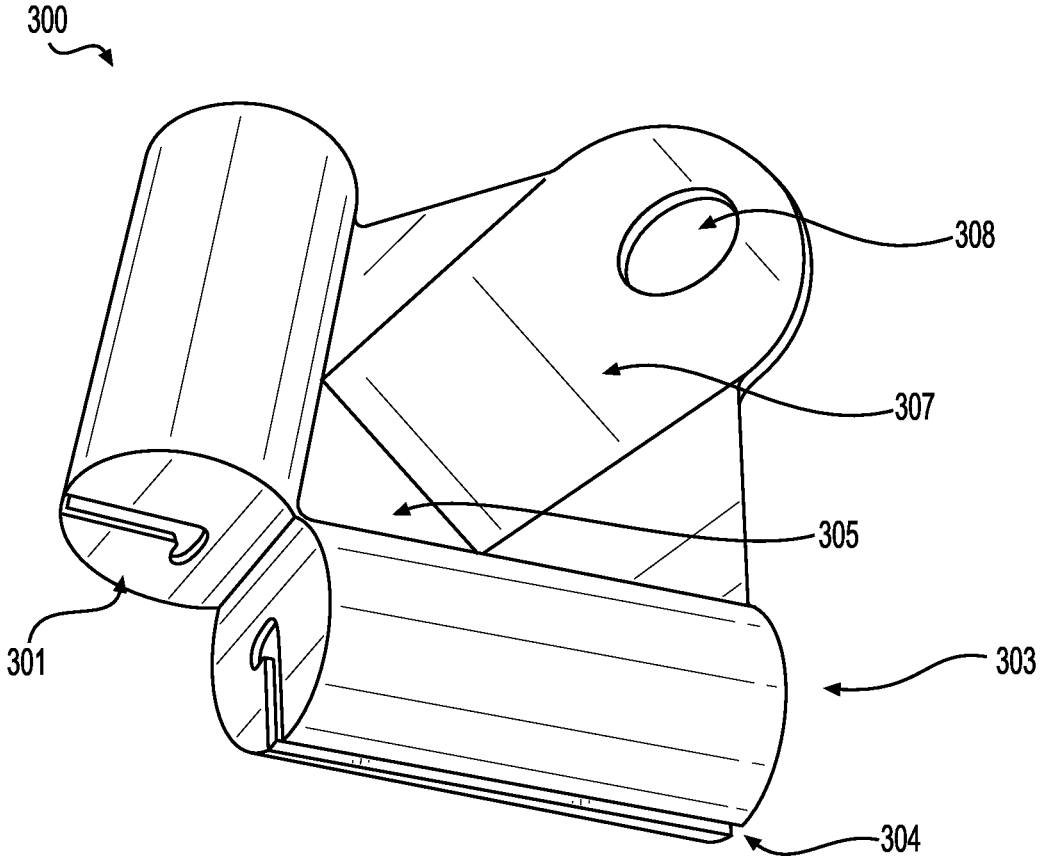
Figure 4B:
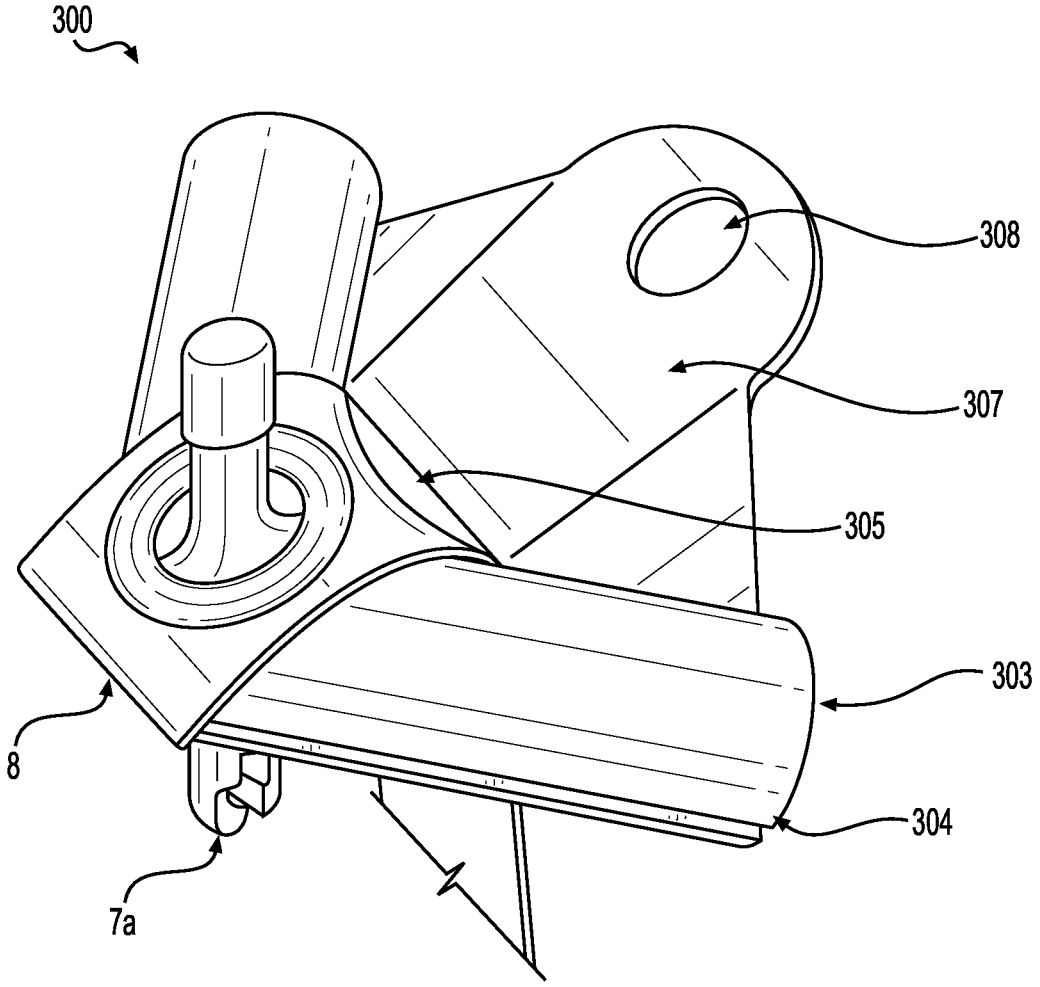
Figure 5:
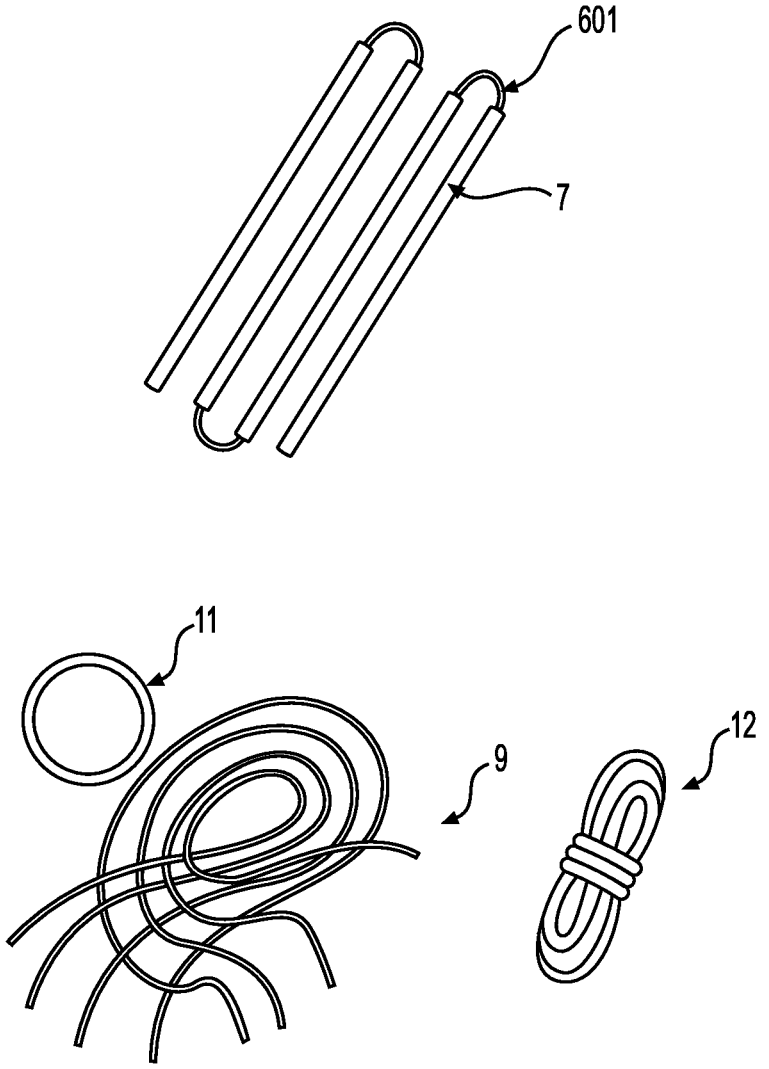
FIG. 5 shows elements of the portable enclosure according to the exemplary embodiment of FIG. 1.

A corner bracket 200 according to an exemplary embodiment is shown in FIG. 3, and a corner bracket 300 according to an exemplary embodiment is shown in FIG. 4A and FIG. 4B. The corner bracket 200 and the corner bracket 300 may be substantially similar in various respects to the corner bracket 100 as described with respect to FIG. 2, FIG. 6, and FIG. 7 of the present application, and the disclosure thereof is incorporated herein by reference, and any repeated disclosure may be omitted for the sake of brevity.

Figure 8:
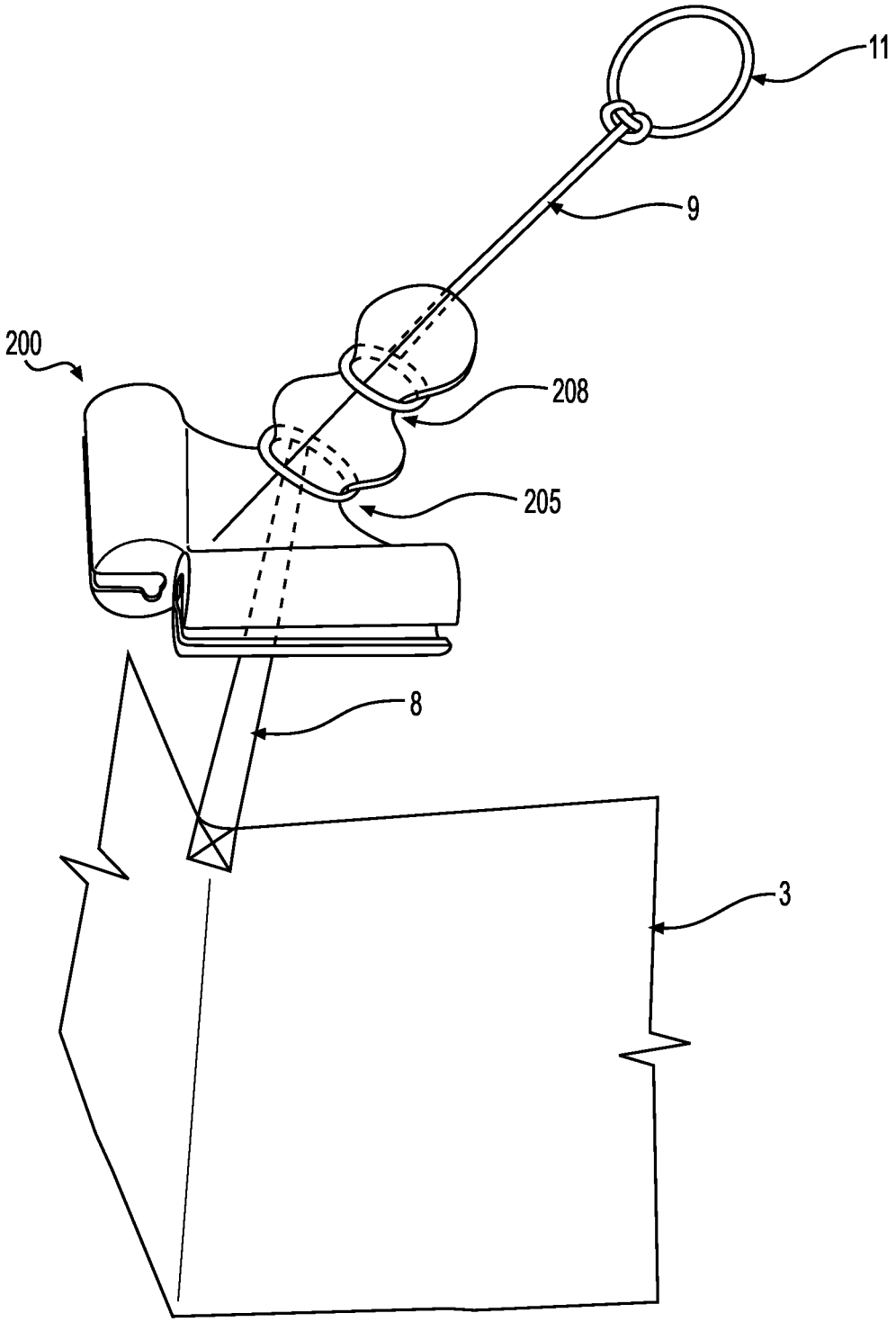
FIG. 8 shows a close-up perspective view of a portable enclosure including the corner bracket of FIG. 3, according to an exemplary embodiment.

The corner bracket 200 includes a first tie-off indent 208 and a second tie-off indent 205. As shown in FIG. 8, the first tie-off indent 208 may be used to securely connect the cord 9 and the second tie-off indent 205 may be used to securely connect the grommeted elastic 8.

Figure 6:
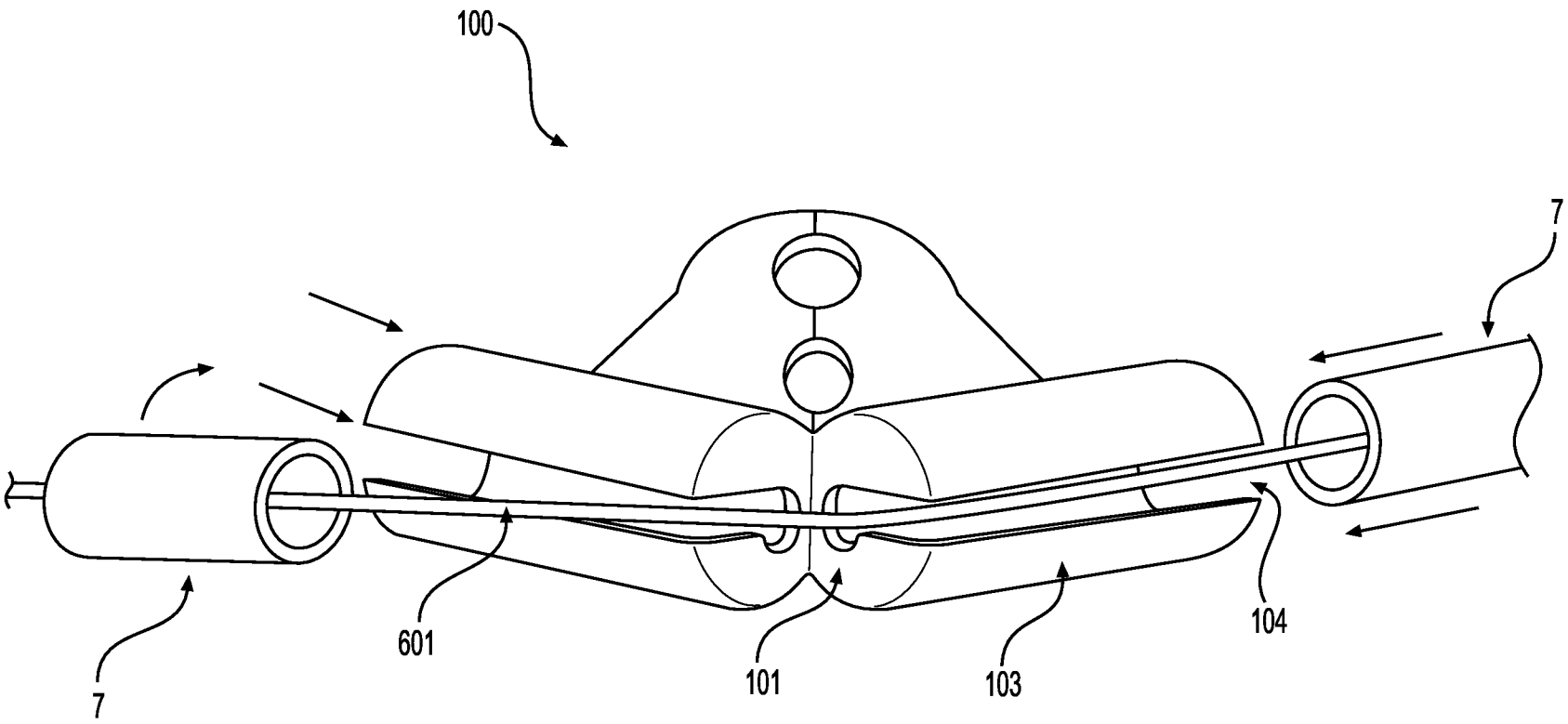
FIG. 6 shows a close-up perspective view of a portable enclosure and corner bracket according to an exemplary embodiment.

The polygon assembly 2 is assembled utilizing the assembly method illustrated in FIG. 6. The end of a rigid rod 7 is inserted into a receptacle 103 of the corner bracket 100 as illustrated in FIG. 6. A rigid rod cord 601 connecting rigid rods 7 traverses the length of the receptacles 103 by utilizing the slot 104 in the receptacle 103 and endcap 101 prior to inserting the end of the rigid rod 7 into the receptacle 103. The process is repeated for the remaining corner brackets 100 used in the polygon assembly 2. The rigid rod cord 601 may not be present.

Figure 7:
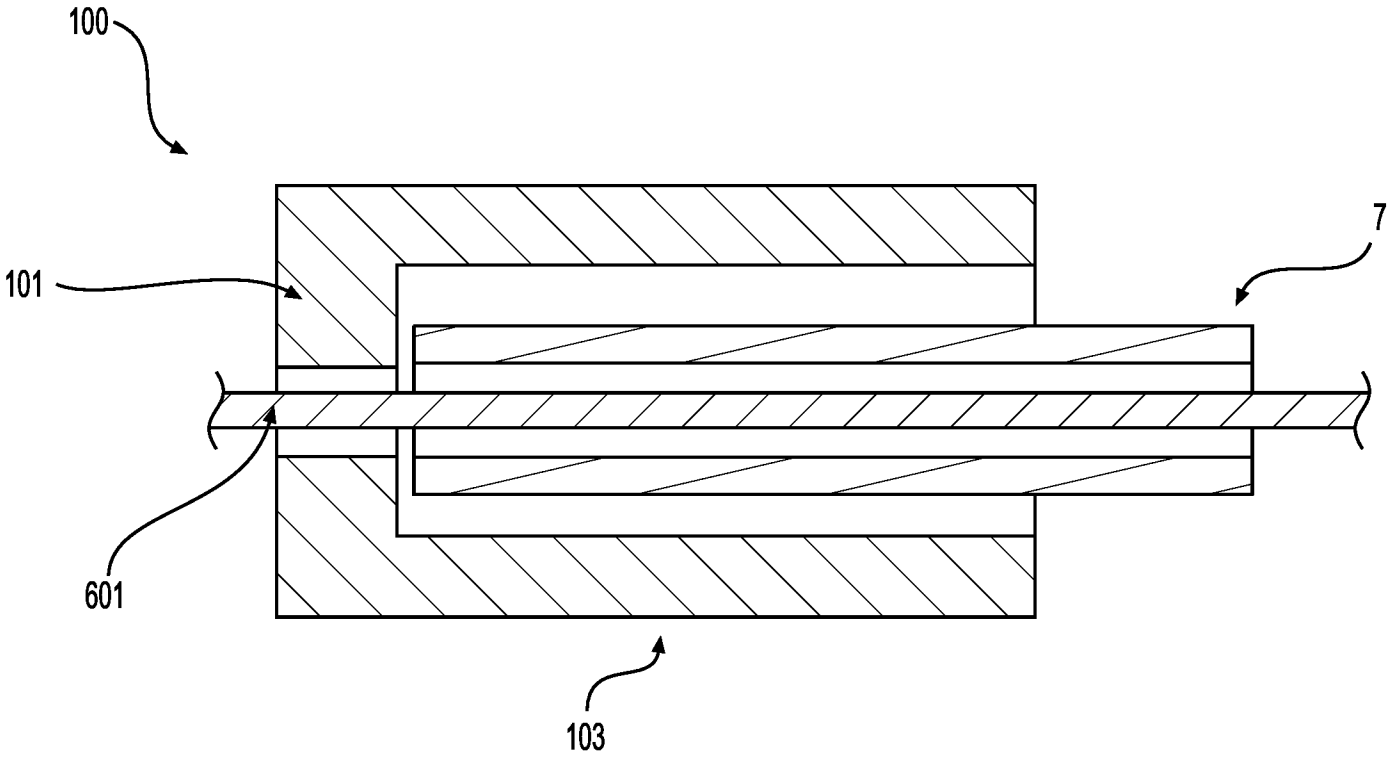
FIG. 7 shows a cross-sectional view of the portable enclosure and corner bracket of FIG. 6.

FIG. 7 illustrates a cross-sectional view of the receptacle 103 of the corner bracket 100 of FIG. 2 and FIG. 6, showing the endcap 101 restraining the rigid rod 7 and the rigid rod cord 601 connecting rigid rods 7 traversing the receptacle 103 and endcap 101.

FIG. 9 illustrates a completed polygon assembly 2. The cord 9 suspending the portable enclosure 1 is removably attached to the first hole 308 of the corner bracket 300 for suspending the portable enclosure 1, and removably attached to the suspending ring 11. The rope 12 suspending the polygon assembly 2 is attached to the suspending ring 11.

The suspending forces cause the rigid rod 7 ends to be inserted into the endcaps 301 of the receptacle 303 of the corner bracket 300, substantially similarly as with respect to the corner bracket 100 as illustrated in FIG. 6 and FIG. 7, thereby securing the rigid rod 7 in the receptacle 303. The disclosure with respect to FIG. 6 and FIG. 7 is incorporated by reference in the present disclosure pertaining to the exemplary embodiment shown in FIG. 1 and FIG. 9. The smallest cross-sectional dimension of the rigid rod 7 end need only be larger than the slot 304 in the receptacle 303 and end cap 301, and the rigid rod 7 may fit loosely within the receptacle 303. The forces resulting from suspension complement any force rigid rod cord 601 may provide. Hence, rigid rod cord 601 connecting rigid rods 7 is optional.

When tent pole assemblies are used as the rigid rods 7, for example, elastic cords may not be present at one or more of the receptacles 303 and excess rigid rod 7 may hang freely. Additional forces may be applied from the grommeted elastic 8 suspending the privacy curtain 3 if the privacy curtain 3 length is less than the combined length of the rigid rods 7.

Rigid rod 7 length is determined by end user needs. Additional considerations for determining rigid rod 7 length include, but are not limited to: the dimensions of the privacy curtain 3; the final weight; and the transportability of the rigid rods 7. In cases of privacy curtain 3 size constraints, the user may choose to leave one or more sides open if visual obscuring is not required in all directions.

Although certain exemplary embodiments and implementations have been described herein, other embodiments and modifications will be apparent from this description.

Accordingly, the inventive concept is not limited to such embodiments, but rather to the broader scope of the presented claims and various obvious modifications and equivalent arrangements.

I claim:

1. A portable enclosure, comprising:

a plurality of corner brackets;

a suspension ring;

a plurality of cords respectively connecting each of the plurality of corner brackets and the suspension ring;

a plurality of rigid rods respectively connecting each of the plurality of corner brackets;

a plurality of rigid rod cords respectively connecting each of the plurality of rigid rods;

a privacy curtain;

a zipper in the privacy curtain, the zipper configured to permit ingress and egress from the privacy curtain;

a plurality of grommeted elastic connectors connecting the privacy curtain and each of the plurality of corner brackets; and a webbing configured to restrain the bottom of the privacy curtain.

2. The portable enclosure of claim 1, wherein the plurality of corner brackets are configured to removably secure the plurality of rigid rods thereto.

3. The portable enclosure of claim 2, wherein the plurality of corner brackets are configured to permit the traversing of plurality of rigid rod cords without interfering with the plurality of rigid rods to be removably secured to the plurality of corner brackets.

4. The portable enclosure of claim 1, wherein the plurality of corner brackets are configured to limit the travel of the plurality of rigid rods near corners of the portable enclosure.

5. The portable enclosure of claim 1, wherein the plurality of cords are removably secured between the plurality of corner brackets and the suspension ring.

6. The portable enclosure of claim 1, wherein the plurality of corner brackets each further comprises a hole formed therein, the hole configured to permit respectively affixing the plurality of grommeted elastic connectors to the plurality of corner brackets.

7. The portable enclosure of claim 1, wherein the plurality of corner brackets each further comprises an area for mounting ancillary accessories.

* * * * *